United States Patent [19]

Duym

[11] 4,142,458

[45] Mar. 6, 1979

[54] ENERGY CONSERVING FUME HOOD

[76] Inventor: Arthur Duym, 134 Willoughby Rd., Fanwood, N.J. 07023

[21] Appl. No.: 852,664

[22] Filed: Nov. 18, 1977

[51] Int. Cl.[2] ..... F23J 11/00

[52] U.S. Cl. ..... 98/115 LH; 49/63; 49/142; 55/DIG. 18; 422/104

[58] Field of Search ..... 98/115 LH, 88 R, 96, 98/97, 98; 23/292; 49/63, 142; 55/DIG. 18; 160/202

[56] References Cited

U.S. PATENT DOCUMENTS

| | | | |
|---|---|---|---|
| 1,648,851 | 11/1927 | Lapin | 160/202 |
| 2,081,745 | 5/1937 | Hohmann et al. | 49/63 |
| 2,715,359 | 8/1955 | Mackintosh et al. | 55/DIG. 18 |

*Primary Examiner*—Ronald C. Capossela
*Attorney, Agent, or Firm*—Peter V. D. Wilde

[57] ABSTRACT

An enclosed fume hood having an access window with a vertically sliding sash is provided with an additional horizontally movable sash which closes off only a fraction of the open window space and thus reduces the volume of air required to be drawn through the window in order to maintain the requisite air velocity while still permitting complete access to the interior of the hood. Provision is also made to permit the horizontally movable sash to be easily removed, when necessary, to permit insertion into the hood of apparatus wider than the residual open window space.

5 Claims, 4 Drawing Figures

ENERGY CONSERVING FUME HOOD

BACKGROUND OF THE INVENTION

Enclosed fume hoods are ordinarily designed with an access window having a vertically sliding sash. The exhaust of air from the hood is arranged so that the velocity of air entering through the window when open is maintained within specified limits. Since these hoods are ordinarily exhausted to a draft system designed to draw an essentially constant volume of air, it is necessary that the hood be designed to deliver essentially the same volume of air to the draft system whether the window is open or closed.

Two bypasses are provided to maintain this required flow of air when the window is shut. The lower bypass is always open and insures the required air velocity past the materials under treatment in the hood. The upper bypass is essentially closed by the vertically sliding sash when it is in its upper, or open, position so that almost all the air entering the hood enters through the window. The upper bypass is open when the vertically sliding sash is in its lower or closed position, thus allowing sufficient air to flow to the exhaust system to compensate for the reduced flow through the window, so that the balance of the exhaust system is maintained.

Thus the volume of air required to be exhausted by the system is determined by the requisite air velocity through the open window, even though the window may be open for accessing only a small part of the operating time. A considerable amount of heated or cooled room air is thus uselessly discharged when the window is closed, representing a substantial energy waste.

SUMMARY OF THE INVENTION

According to the present invention, a reduction is achieved in the volume of air required to be pumped by the exhaust system, while still maintaining the requisite air velocity through the open window, by placing behind the vertically sliding sash a horizontally sliding sash which closes a fraction of the open window space. Thus only the remaining portion of the window space is open at any one time, so that the proper air velocity can be maintained with a volume of air flow which is reduced by the fraction closed. Access to any part of the hood is not unduly impeded since the sash can be moved horizontally to any position.

Further, by providing an upper track as the main support for the horizontally moving sash and by providing a mere guide at the lower edge of the sash which can be released to allow the sash to be tilted while still riding on the upper track and then removed, additional momentary access can be provided for equipment wider than the residual window opening.

DETAILED DESCRIPTION

Figure 1:
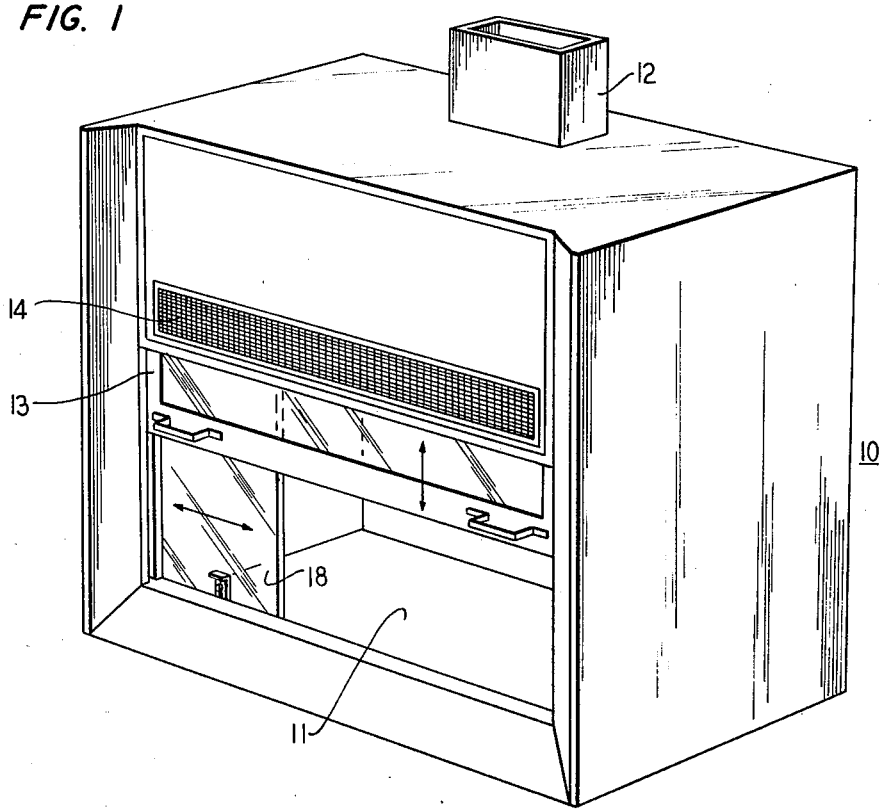
FIG. 1 is an isometric view of the fume hood of the present invention with the vertical sash in an open position.
Figure 2:
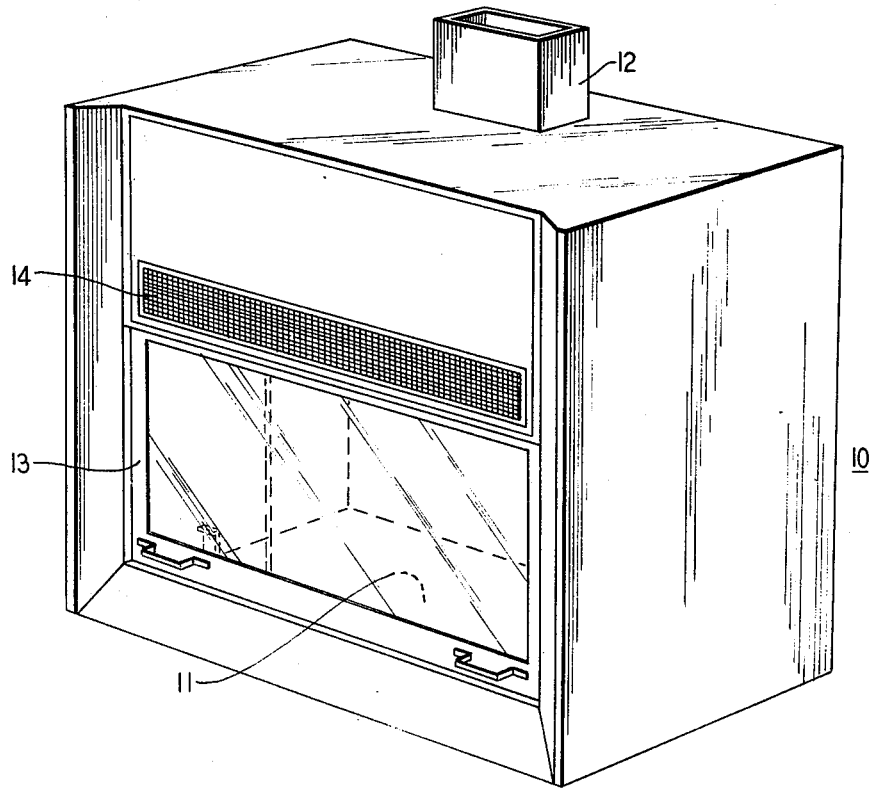
FIG. 2 is an isometric view of the fume hood with the vertical sash in its closed position.

The fume hood of the present invention, as shown in FIGS. 1 and 2, comprises, as in the prior art, a structure 10 enclosing a working surface 11 and isolating it from the surrounding environment. Air is exhausted through duct 12 opening into the structure. The structure is provided with an access window provided with a vertically sliding sash 13 which leaves the window open in its raised position and closed in its lowered position.

When the vertically sliding sash is closed, air is drawn into the hood through an upper bypass grilled opening 14 and a lower opening 15 (FIGS. 3 and 4) between the frame 16 and floor 17 of the hood. When the sash is in its open position, it blocks off and closes bypass opening 14 so that a corresponding amount of air is drawn in through the open window and thus maintains the requisite air velocity through the window. Since the useful air sweeping the hood when the window is closed is that entering through lower opening 15 while that entering through bypass 14 represents essentially a wasted discharge of heated or cooled room air, it is desirable that the amount of air so drawn in through bypass 14 be kept as small as possible.

The amount of wasted air which is drawn through bypass 14 is determined by the volume of air needed to maintain the requisite air velocity through the open window. Horizontally movable sash 18 of the present invention reduces the size of the window opening, while allowing access to the working surface in the hood, and thus permits the maintenance of the requisite velocity with a volume of air flow reduced by a proportion corresponding to the ratio of the width of the horizontally moving sash to the width of the window opening. This sash desirably has a horizontal width between $\frac{1}{4}$ and $\frac{1}{2}$, and conveniently about $\frac{1}{3}$, of the horizontal width of the window opening.

Figure 3:
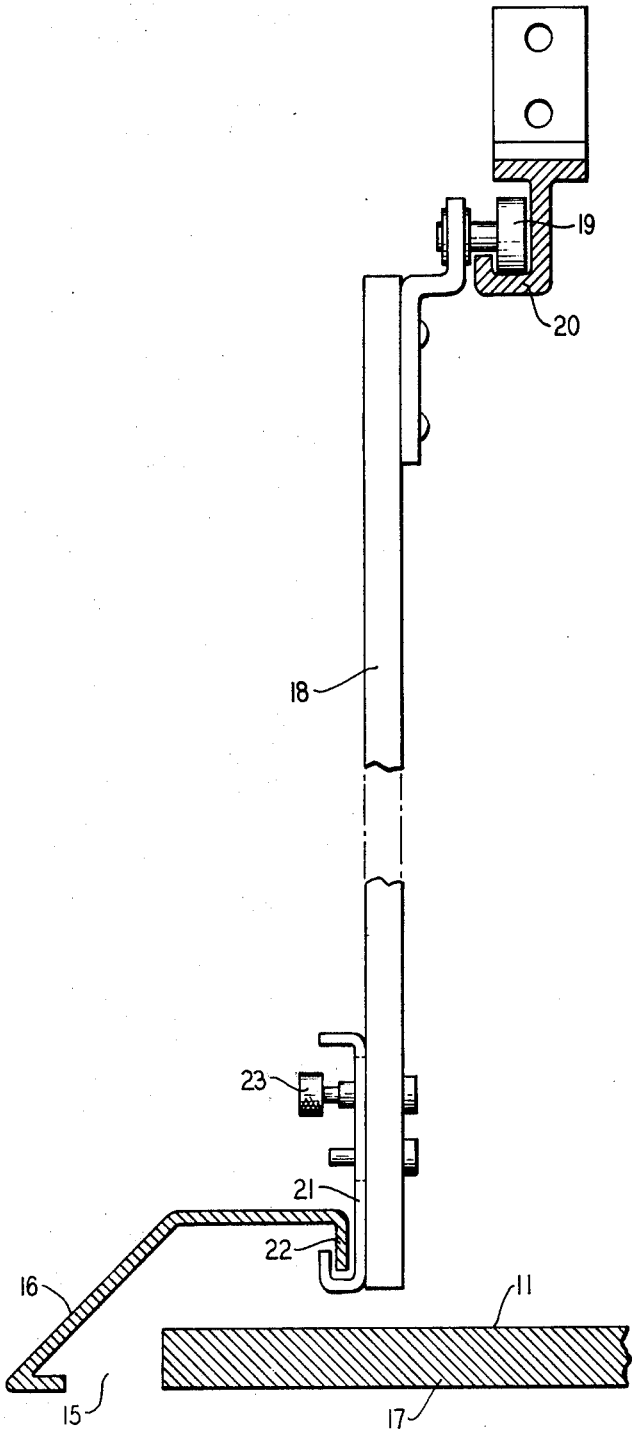
FIG. 3 is a sectional view of the horizontally movable sash with its supporting track and releasable guide.
Figure 4:
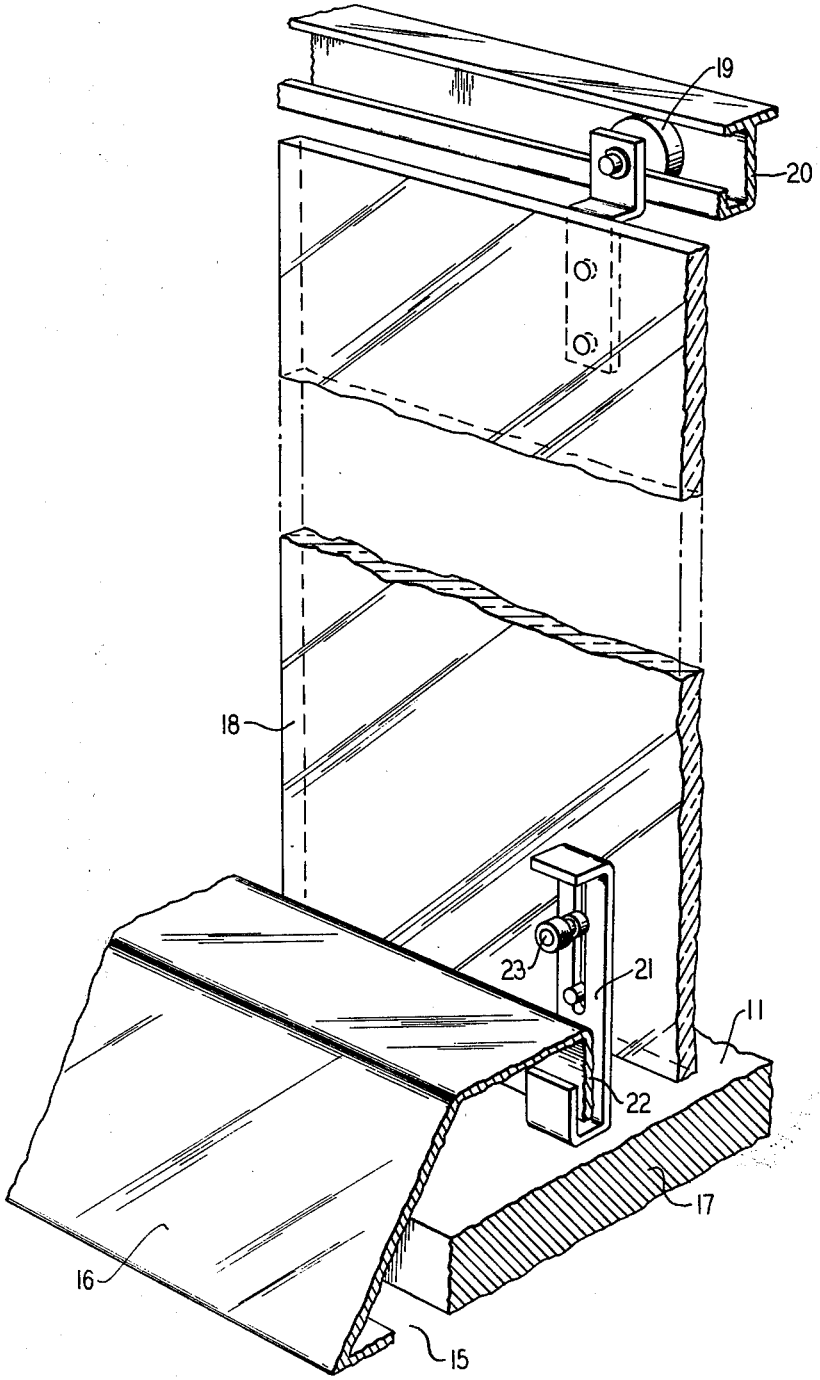
FIG. 4 is an isometric view, partly in section, of the elements shown in FIG. 3.

This sash is preferably formed of transparent material such as plastic or glass. It is conveniently supported, as shown in FIGS. 3 and 4, by mounting two or more wheels at its upper edge, which ride on track 20 supported at its ends by the side walls of the enclosing structure. The loose support in the track permits the ready removal of the sash by tilting inwardly to permit insertion into the hood of apparatus wider than the residual window opening.

The lower edge of the sash is provided with a member 21 which normally rides in along the inner edge 22 of frame 16 as a guide.

The sash can be moved to any horizontal position across the width of the window to permit access to any part of the working surface. When the sash is to be tilted and removed, fastening screw 23 is released allowing member 22 to be disengaged from its guide.

What is claimed is:

1. A fume hood comprising a structure enclosing a working surface and isolating it from the surrounding environment, an opening in said structure for connecting an air exhaust duct, a window in said structure providing access to the working surface and a vertically sliding sash for opening and closing said window, wherein the improvement comprises a horizontally movable sash closing off only a fraction of the horizontal width of said window and positionable at any point across the width of the window, whereby the volume of air required to be drawn through the window to maintain the mimimum necessary air velocity when the vertically sliding sash is in the open position is reduced by said fraction but access to any portion of the working surface can be obtained by the positioning of said horizontally movable sash.

2. A fume hood as defined in claim 1 wherein the horizontally movable sash is transparent and closes off at least ¼ but not more than ½ of the horizontal width of the window.

3. A fume hood as defined in claim 2 wherein the horizontally movable sash closes off about ⅓ of the horizontal width of the window.

4. A fume hood as defined in claim 1 wherein the horizontally movable sash is supported at its upper edge and is inwardly tiltable and removable to permit insertion into the hood of apparatus wider than the width of the open area of the window remaining when the said fraction is closed off.

5. A fume hood as defined in claim 4 wherein the horizontally movable sash has an upper edge riding on an upper horizontal track and a lower edge releasably held by a lower guide.

* * * * *

UNITED STATES PATENT AND TRADEMARK OFFICE

CERTIFICATE OF CORRECTION

PATENT NO. : 4,142,458

DATED : March 6, 1979

INVENTOR(S) : Arthur Duym

It is certified that error appears in the above-identified patent and that said Letters Patent are hereby corrected as shown below:

After "Inventor: Arthur Duym, 134 Willoughby Rd., Fanwood, N.J. 07023"
insert
--Assignee: Bell Telephone Laboratories, Incorporated, Murray Hill, N.J.--.

Signed and Sealed this

*Thirteenth* Day of *January 1981*

[SEAL]

*Attest:*

SIDNEY A. DIAMOND

*Attesting Officer*

*Commissioner of Patents and Trademarks*